US008578918B1

(12) United States Patent
Islas

(10) Patent No.: US 8,578,918 B1
(45) Date of Patent: Nov. 12, 2013

(54) CROSSBOW WITH BOWSTRING REDIRECTION

(71) Applicant: John J. Islas, Baldwinsville, NY (US)

(72) Inventor: John J. Islas, Baldwinsville, NY (US)

( * ) Notice: Subject to any disclaimer, the term of this patent is extended or adjusted under 35 U.S.C. 154(b) by 0 days.

(21) Appl. No.: 13/782,446

(22) Filed: Mar. 1, 2013

(51) Int. Cl.
*F41B 5/12* (2006.01)

(52) U.S. Cl.
USPC ..... 124/25

(58) Field of Classification Search
USPC ..... 124/23.1, 25, 25.6
See application file for complete search history.

(56) References Cited

U.S. PATENT DOCUMENTS 4,169,456 A * 10/1979 Van House ..... 124/61
4,388,914 A * 6/1983 Cesin ..... 124/27
4,662,345 A 5/1987 Stephens
7,100,590 B2 9/2006 Chang
7,188,615 B2 3/2007 Chang
7,823,572 B2 * 11/2010 Anderson ..... 124/25
7,832,386 B2 11/2010 Bednar et al.
8,191,541 B2 6/2012 Shaffer et al.

* cited by examiner

*Primary Examiner* — John Ricci
(74) *Attorney, Agent, or Firm* — Bernhard P. Molldrem, Jr.

(57) ABSTRACT

A crossbow employs bowstring redirecting wheels, over which the bowstring travels, to keep the bowstring aligned with the main force vectors where the bowstring meets the tips of the crossbow power limbs or spring limbs. The bowstring is anchored to a fixed anchor points, which can be on the pylons on which the redirecting wheels are mounted, or may be at the tips of the spring limbs. In one embodiment the bowstring passes over a pulley wheel at the tip of the spring limb. This crossbow arrangement achieves superior acceleration, and can be constructed of smaller transverse dimension than conventional or compound crossbows.

10 Claims, 3 Drawing Sheets

CROSSBOW WITH BOWSTRING REDIRECTION

This application claims priority under 35 U.S.C. §119(e) of Provisional Pat. Appln. 61/619,980, filed Apr. 4, 2012, the disclosure of which is incorporated herein by reference.

BACKGROUND OF THE INVENTION

This invention is directed to the field of archery, and more specifically to crossbows with features to program the draw weight to optimize the energy and velocity of the projectiles launched from the crossbow. Applicant incorporates by reference Published Application US 2011-0308508, Dec. 22, 2011.

Crossbows that include means to regulate their draw weight typically take the form of compound bow systems, with various cams and cables, which make the crossbows complicated and expensive.

It is an objective of modern crossbows to transfer to the bolt or arrow as much as possible of the energy that is stored in the bow, so that the projectile will fly faster and farther. These goals have been difficult to achieve. Some inefficiencies are due to mechanical losses in the crossover strings and pulley mechanisms that have universally been employed in compound bow systems.

The present invention seeks to obtain the advantages in controlled draw weight characteristics with a crossbow of the recurve limb design, i.e., the type that does not employ crossover cables, synchronizing pulleys or cam wheels on the riser or limbs of the bow.

The invention also seeks to improve the characteristics of the crossbow with a simple pulley system that permits a smaller amount of bend of the power limbs between release and brace.

OBJECTS AND SUMMARY OF THE INVENTION

Accordingly, the crossbow of this invention employs bowstring re-directing wheels or pulleys that are supported on one or more support struts positioned proximally of the recurve limbs, so that the bowstring applies tension in the direction more or less tangent to the bend axis of the limb, rather than having a tension component angled out from the limb. Preferably, there is a set of forward or distal re-directing wheels and another set of rearward or proximal re-directing wheels, so that a range between full release and partial draw the bowstring is in contact with the forward wheels, and at a range between near full draw and full draw or full brace, the bowstring is in contact with the rearward wheels. The redirecting wheels on each side of the beam or stock can be supported on separate struts or on a single strut. The re-direction of the bowstring through its travel from full brace to release creates a mechanical advantage in the travel of the crossbow bolt, so that it achieves an increase in kinetic energy and velocity over other systems. In other words, the bolt or arrow accelerates throughout the travel of the bowstring, resulting in significantly higher velocity.

In an alternative embodiment, a crossbow likewise has a stock situated at a medial plane of the crossbow, the stock or beam having a proximal end and a distal end. A bow is mounted at a forward or distal end of the stock, the bow being formed of a pair of spring limbs, with these spring limbs being disposed one at each side of the stock. A bowstring is secured at its ends at respective anchor points that are fixed relative to the stock, and in this embodiment the bowstring passes over a pair of pulley wheels that are positioned at the ends of the spring limbs. The bowstring is adapted to accelerate a bolt, arrow, or similar projectile when released from a full draw position. In this embodiment at least one strut member, or pylon, extends to left and right sides of the stock; and preferably there may be right and left pylons positioned at left and right sides of the stock. The strut member or members have left and right distal re-directing wheels mounted thereon and positioned proximally of the bow and have left and right proximal re-directing wheels also mounted thereon positioned proximally of the afore-mentioned distal re-directing wheels and distally of the proximal end of the stock. The distal re-directing wheels are adapted to contact the bowstring between a partial draw and full release position of the crossbow, and the proximal re-directing wheels are adapted to contact the bowstring between a partial draw and full-draw position, so that the bowstring achieves an increased transfer of kinetic energy to the projectile. The re-directing wheels are positioned so as to maintain the tension vector of the bowstring so that at the points where it reaches the pulleys, the vector lies along or near bending moments of the respective spring limbs between the full draw and release positions. Preferably, there is a left strut or pylon and a right strut or pylon, each projecting back proximally from the bow on left and right sides of the stock, respectfully, and with the respective proximal and distal re-directing wheels being supported one behind the other on the left strut and the right strut, respectively. In this embodiment, the anchor points at which the ends of the bowstring are secured are located on the left and right struts or pylons, respectively, just distal of the distal re-directing wheels. The resulting pulley action on the bowstring and spring limbs achieves a mechanical advantage of substantially 2:1, that is, there is only about one-half the flexing of the bow spring limbs for the same amount of draw in comparison with the first two embodiments. The reduced movement of the spring limb assists in keeping the bowstring aligned with the force vector of the spring limb, and in addition, the spring limb can be shorter than with other crossbow configurations, making the crossbow smaller laterally, which is an advantage to the archer.

The above and many other objects, features, and advantages of the crossbow of this invention will become apparent from the following detailed description of selected preferred embodiments, to be considered in connection with the accompanying figures of drawing.

DETAILED DESCRIPTION OF A PREFERRED EMBODIMENT

Figure 1:
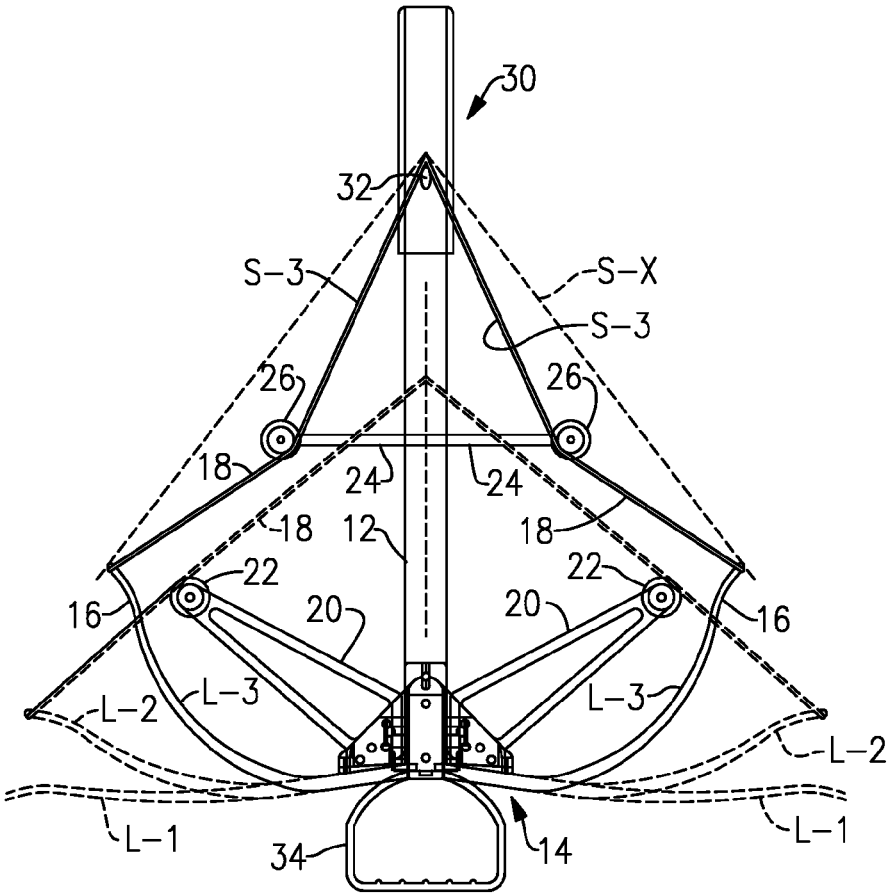
FIG. 1 is a plan view of a crossbow embodying this invention.

The invention is explained in terms of a possible preferred embodiment, here a crossbow 10, in which there is an axial beam or stock 12 defining a medial plane with a recurve bow 14 that extends transversely across the front or distal end of the stock or beam. At the right and left of the recurve bow 14 there is a spring limb 16, i.e., a spring limb at the right side and one at the left side. A bowstring 18 is anchored at each end at an eye or anchor point 17 at the end of the respective limb 16.

As shown in FIG. 1, there is a set of right and left distal struts or pylons 20 in which are mounted left and right redirecting wheels or pulleys 22. These wheels 22 contact the bowstring 18 when the limbs 16 are forward i.e. when the crossbow is fully released. In this embodiment, there is a second set of transverse struts or pylons 24 located farther back along the beam or stock 12 with a respective right and left rearward re-directing wheels or pulleys 26. These wheels 26 are positioned so that the bowstring 18 contacts the wheels 26 between a full draw position and a position near full draw, as illustrated. Also shown in FIG. 1 is a grip portion 30 located at a proximal end of the stock 12, with a bowstring release 32 at the full-draw position of the string, and with a stirrup 34 at the nose or distal end of the stock 12. The stirrup 34 may be used as a foothold in loading and cocking the crossbow 10. Also a finger trigger mechanism (not shown here) is present at the grip end of the stock. A track on the top of the beam or stock provides a path for the bolt or arrow.

In FIG. 1, the limbs 16 are shown in the full release position (indicated by L-1), an intermediate position (indicated by L-2) and its fully drawn or full-brace position (indicated by L-3). In the fully relaxed or release position (L-1) the bow string 18 lies on the forward or distal re-directing wheels 22; as the bowstring is drawn back it leaves the redirecting wheels 22 and is directed straight to the anchor points on the limbs 16. As the bow string is drawn farther back, it engages the rear or distal re-directing wheels 26, and this bends the bow string as indicated at S-3, where the string tension is directed along the line of force of the flexed limb 16, so that the component of tension that is transverse to that force line is kept minimal. For comparison purposes, the broken line S-X illustrates the hypothetical line of the string from the bow release 32 to the limb 16 in the full-brace L-3 position, as it would extend if the re-directing wheels 26 were not present. It can be seen that with the string tension vector controlled by re-directing wheels, the transfer of energy from the crossbow limbs 16 to the projectile is more efficient and more direct.

Figure 2:
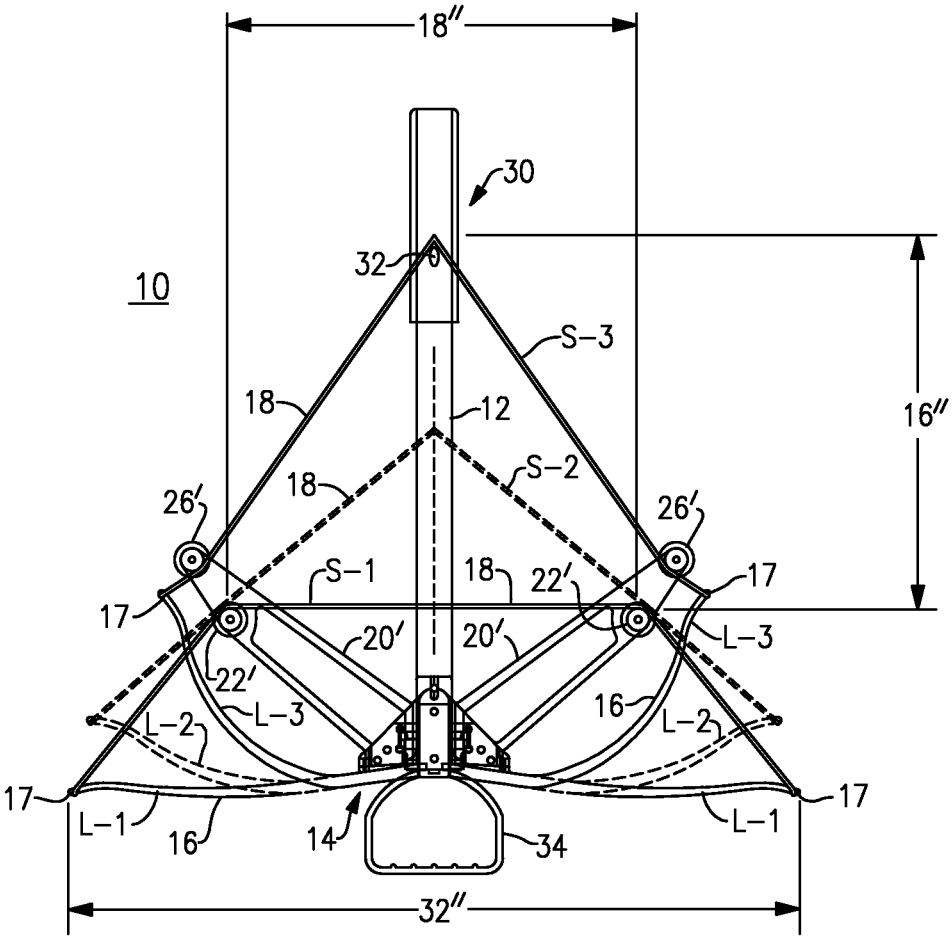
FIG. 2 is a plan view of another crossbow embodying this invention.

Another embodiment of the crossbow of my invention is shown in FIG. 2, in which the elements of the crossbow that are correspond to elements of the prior embodiment are identified with the same reference numbers, but those that are changed have primed reference numbers. Here, the crossbow has a stock or beam 12, recurve bow 14 with limbs 16, a bowstring 18, a grip portion 30 at the proximal end and a stirrup 34 at the distal end. Here instead of forward and rear struts, there is a single left strut or pylon 20' and a single right strut or pylon 20' with the forward or distal re-directing wheels 22' being mounted on these struts and with the rear or proximal re-directing wheels 26' mounted just beyond them on the same struts. The struts 20' have an open frame design to minimize added weight.

The action of the limbs 16, bow string 18 and re-directing wheels 22' and 26' can be explained with reference to the released position L-1, intermediate position L-2 and full draw position L-3 of the bow 14, and the corresponding position of the bow string. In the fully released position, the bow string 18 contacts against the wheels 22' and forms a trapezoidal shape as indicated at S-1, with the string passing transversely between the wheels 22' and then angling down to the anchor points at the ends of the limbs 16. As the string is drawn back, at an intermediate position S-2, the limbs 16 are bowed in (position L-2), and the string leaves contact with the redirecting wheels 22'. Then with further draw back, the string extends directly to the anchor points until a position is reached near the full draw at which the bow string engages the rear re-directing wheels 26'. Between that point and the full draw, illustrated at L-3 and string position S-3, the bow string is again deflected to lie, at each end, along or close to the bending moment of the corresponding limb. When the archer actuates the crossbow release, the action of the flexed limbs 16 moves the bow string, first over the re-directing wheels 26', then directly, in the gap between the wheels 26' and 22', and then over the re-directing wheels 22'. This creates optimal acceleration of the crossbow bolt, to yield maximum transfer of kinetic energy with maximum velocity to the bolt. As shown in FIG. 2, the crossbow of this embodiment may have a spread of thirty-two inches (about 81 cm) from tip to tip of the limbs 16 in the full release position; with a separation of 18 inches between the re-directing wheels 22', and with a draw length, from full brace to release, of 16 inches. As presented by these embodiments, the separation of the rear or proximal re-directing wheels 26 or 26' may be greater than, equal to, or less than that between the forward re-directing wheels, depending upon the characteristics of the limbs, etc.

The use of the strut-mounted re-directing wheels improves the energy and the flight of the projectile, but without the complexity and energy loss that is present in currently existing compound crossbow systems. Also, with no crossover cables or synchronizing pulley, this invention yields high-performance crossbows of a simpler, more robust design. The limbs herein may be constructed shorter than on bows or crossbows of standard design, reducing the overall width of the crossbow, and making it easier to carry through dense brush or cover.

Alternatively, the crossbow may be constructed with only the forward re-directing wheels or with only the rearward re-directing wheels. The principles of this invention can, in theory, also be applied to a long bow, in which case the struts for the re-directing wheels may be mounted on the riser of the bow, as there is typically no beam or stock as with the crossbow.

Figure 3:
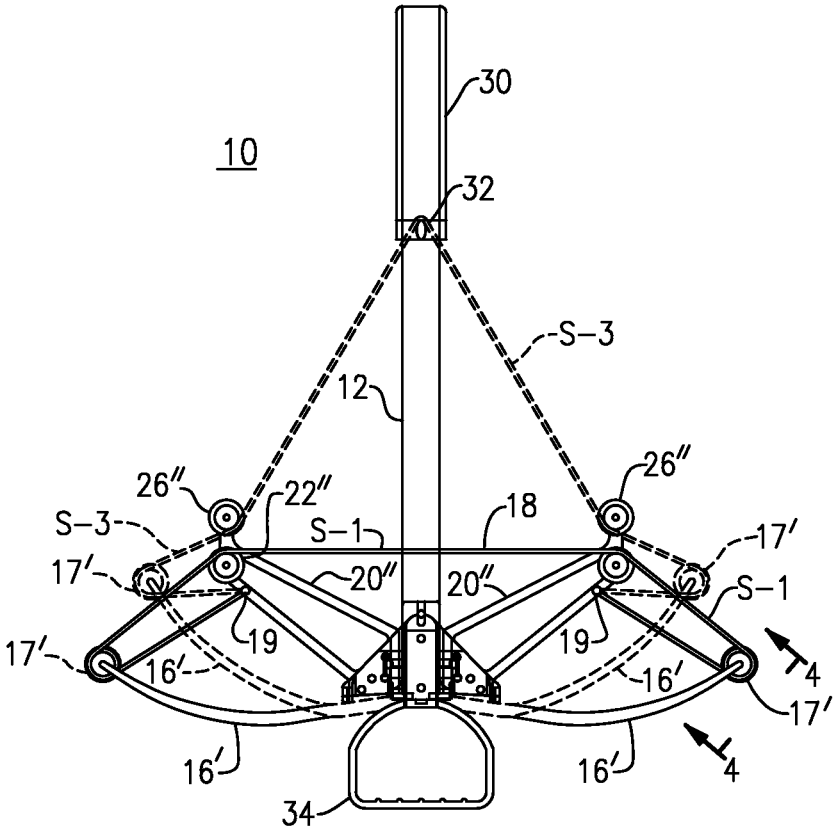
FIG. 3 is a plan view of still another embodiment of the invention.

FIG. 3 is a plan view of a further embodiment of the crossbow of the present invention, and where the elements of this embodiment are the same as those in the other embodiments, similar reference numbers are employed, but where the elements are changed, a prime (') or double-prime (") is used. In this embodiment, the crossbow 10 has a stock or beam 12, bow 14 with power limbs or spring limbs 16', a bowstring 18, a grip portion 30 at the proximal end and a stirrup 34 at the distal end of the stock. As with the second embodiment there is are left strut or pylon 20" and right strut or pylon 20" with the forward or distal re-directing wheels 22" being mounted on these struts and with the rear or proximal re-directing wheels 26" mounted just beyond them on the same struts. In this embodiment the pylons each have a finger portion holding the proximal re-directing wheel a short distance behind the distal re-directing wheel.

Figure 4:
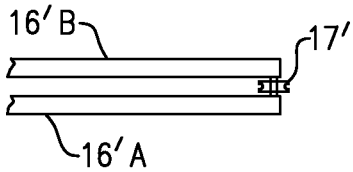
FIG. 4 is a view taken at 4-4 of FIG. 3

In this embodiment, each of the spring limbs 16' has a pulley or wheel 17' mounted at or near the tip of the spring arm. This is shown in cross-section in FIG. 4, the spring limbs are of a split power limb design with each spring arm 16" being formed of lower and upper portions 16'A and 16'B, with the wheel or pulley 17' being supported by a pivot or bearing between these two limb portions. The pulley wheels 17' are not drawn to an exact scale here, and these may be made smaller in diameter and of light-weight materials so as to avoid adding unnecessary mass to the tips of the bow limbs.

The ends of the bowstring 18 are attached at anchor points 19 on the two pylons 20" at a position just ahead of (i.e., just distal of) the forward or distal re-directing wheel 22". The bowstring 18 passes from the anchor point, around the pulley 17' of the associated spring limb, then between the sets of re-directing wheels and around the pulley 17' of the other spring limb and to the anchor point 19 on the other pylon.

FIG. 3 shows the crossbow with the limbs 16', pulley wheel 17' and bowstring 18 in full release position (S-1) and full draw or full brace position (S-3), the latter being illustrated in broken line. Due to the pulley action, the movement of the limbs 16' between release and full draw is only one-half that of the earlier-described embodiments. This means there is less kinetic energy wasted in moving the bow limbs upon release of the bowstring, and that the bowstring is kept better aligned with the spring limb force vector. In addition, the transverse width of the bow, that is the span between tips of the spring limbs 16' is reduced, in this case to about twenty-six inches (about 66 cm). The redirection from the proximal wheels 26" actually lengthens the draw, in this embodiment, by about two inches, compensating for the shorter dimension of the bow power limbs.

While the invention has been described and illustrated in respect to selected preferred embodiments, it should be appreciated that the invention is not limited only to those embodiments. Rather, many modifications and variations would present themselves to those of skill in the art without departing from the scope and spirit of this invention, as defined in the appended claims.

I claim:

1. A crossbow comprising a stock situated at a medial plane of the crossbow and having a proximal end and a distal end, a recurve bow mounted at a distal end of the stock, the bow including pair of spring limbs disposed one at each side of the stock; wherein a bowstring is anchored at each end to an anchor point on each of the respective limbs and is adapted to accelerate a projectile when released from a full brace position; at least one strut member extending to right and left sides of the stock and having mounted thereon left and right distal re-directing wheels positioned proximally of the bow and having also mounted thereon left and right proximal re-directing wheels positioned proximally of the aforementioned distal re-directing wheels and distally of the proximal end of the stock; wherein the distal re-directing wheels are adapted to contact the bowstring between a partial draw and full release position of the crossbow, and the proximal re-directing wheels are adapted to contact the bowstring between a partial draw and full brace position, so that the bowstring achieves an increased transfer of kinetic energy to the projectile.

2. The crossbow of claim 1 wherein the re-directing wheels are positioned to maintain the tension vector of the bowstring to lie along or near bending moments of the respective limbs between the full brace and release positions.

3. The crossbow of claim 1 wherein said at least one strut member includes a left strut and a right strut each projecting back proximally from the bow on left and right sides of the stock, respectfully.

4. The crossbow of claim 3 wherein the respective proximal and distal re-directing wheels are supported one behind the other on said left strut and said right strut, respectively.

5. A crossbow comprising a stock situated at a medial plane of the crossbow and having a proximal end and a distal end, a bow mounted at a distal end of the stock, the bow including a pair of spring limbs disposed one at each side of the stock, wherein a bowstring is secured at each end thereof at a respective anchor point fixed relative to the stock, and wherein the bowstring passes over a pair of pulley wheels disposed respectively at the ends of the spring limbs, the bowstring being adapted to accelerate a projectile when released from a full draw position; at least one strut member extending to left and right sides of the stock and having mounted thereon left and right distal re-directing wheels positioned proximally of the bow and having also mounted thereon left and right proximal re-directing wheels positioned proximally of the aforementioned distal re-directing wheels and distally of the proximal end of the stock; wherein the distal re-directing wheels are adapted to contact the bowstring between a partial draw and full release position of the crossbow, and the proximal re-directing wheels are adapted to contact the bowstring between a partial draw and full-draw position, so that the bowstring achieves an increased transfer of kinetic energy to the projectile.

6. The crossbow of claim 5 wherein the re-directing wheels are positioned to maintain the tension vector of the bowstring to lie along or near bending moments of the respective spring limbs between the full draw and release positions.

7. The crossbow of claim 5 wherein said at least one strut member includes a left strut and a right strut each projecting back proximally from the bow on left and right sides of the stock, respectfully.

8. The crossbow of claim 7 wherein the respective proximal and distal re-directing wheels are supported one behind the other on said left strut and said right strut, respectively.

9. The crossbow of claim 8 wherein said anchor points at which the ends of the bowstring are secured are located on said left and right struts, respectively, distal of the distal re-directing wheels.

10. The crossbow of claim 8 wherein said bowstring and said pulley wheels achieve a mechanical advantage of substantially 2:1.

* * * * *